United States Patent [19]

Bertagni

[11] 4,257,325

[45] Mar. 24, 1981

[54] MOUTING OF A SUBSTANTIALLY PLANAR DIAPHRAGM DEFINING A SOUND TRANSDUCER

[76] Inventor: José J. Bertagni, Buenos Aires, Argentina

[21] Appl. No.: 24,456

[22] Filed: Mar. 27, 1979

[30] Foreign Application Priority Data

Apr. 5, 1978 [AR] Argentina ..... 271695

[51] Int. Cl.[3] ..... G10K 13/00; H04R 7/00

[52] U.S. Cl. ..... 181/172; 181/174; 181/199; 181/DIG. 1

[58] Field of Search ..... 181/174, 171, 172, 157, 181/DIG. 1, 144–147, 199

[56] References Cited

U.S. PATENT DOCUMENTS

| | | | |
|---|---|---|---|
| 3,596,733 | 8/1971 | Bertagni | 181/157 |
| 3,779,336 | 12/1973 | Bertagni | 181/174 |
| 3,801,943 | 4/1974 | Bertagni | 179/115.5 R |
| 4,003,449 | 1/1977 | Bertagni | 181/174 |

*Primary Examiner*—L. T. Hix
*Assistant Examiner*—Benjamin R. Fuller
*Attorney, Agent, or Firm*—Fleit & Jacobson

[57] ABSTRACT

Mounting of a substantially planar diaphragm defining a sound transducer, having a central portion surrounded by stepwise interconnected outer plates to assure correctly guided vibratory movement of the central portion. Recesses in the central portion opening into the front face thereof, housing and supporting therein tweeters, the sound emission axes of which may be so oriented that they converge towards the rear face of the central portion.

10 Claims, 10 Drawing Figures

MOUTING OF A SUBSTANTIALLY PLANAR DIAPHRAGM DEFINING A SOUND TRANSDUCER

BACKGROUND OF THE INVENTION

1. Field of the Invention:

This invention relates to the mounting of a substantially planar diaphragm defining a sound transducer, and more particularly it refers to the mounting preferably used for small surface diaphragms which may be used amongst others as loudspeakers for motor cars.

However, it should be clearly understood that the invention is likewise applicable to other fields, such as upon manufacturing a substantially planar diaphragm of a cellular material having sealed cells, for instance made of polystyrene, such diaphragm can work in combination with a hermetically sealed electromagnetic assembly, underwater, and it may there operate both as a microphone as well as a loudspeaker, so that several divers may communicate underwater or instructions may be transmitted to dolphins.

2. Description of the Prior Art:

Flat or planar loudspeakers with an excellent output are already known, when the size of the diaphragm is rather substantial of the type of 70 cm x 50 cm, because it is then possible to surround the zone destinated to vibrate in order to generate the sound, by a substantial marginal zone made of the same material as the vibrating zone and only such marginal zone is mounted by its peripheral portion on a stationary frame. Thus, the vibrating zone of the diaphragm is suitably guided without there existing any danger of undesirable deviations, which could harm the driver unit of the electro-magnetic assembly. More particularly, there is no substantial danger that the coil of such electro-magnetic assembly could be deviated within its gap to even reach the point where the coil enters in frictional contact with the magnet. This type of planar loudspeaker has been disclosed in my previous U.S. Pat. Nos. 3,596,733, 3,801,943 and 3,779,336.

Loudspeakers of the common frusto-conical diaphragm type, when used in motor-cars, are usually located in a horizontal position so that the opening or mouth of the frusto-conical diaphragm defines a good dust-collector of the dust and other particles floating in the air and have a tendency to fall into the diaphragm entering the gap of the electro-magnetic driver and thereby, sooner or later, establishing a frictional connection which represents the end of a good sound transmission.

SUMMARY OF THE INVENTION

The aspect of the dust particles just explained in the last paragraph will be avoided, if it becomes possible to use a planar diaphragm. It is therefore an object of the present invention, to conceive a small size planar diaphragm such as of 15 cm x 10 cm and even smaller ones, which can be suitably supported in a stationary frame to assure that the front face of the diaphragm is able to vibrate between a maximum and a minimum through planes which are substantially parallel amongst themselves.

To achieve this effect, a mounting of a substantially planar diaphragm is herewith proposed which defines a sound transducer, comprising a central body having a substantially planar front face and a rear face, the central portion of the rear face of said central body defining an impact-receiving zone and the peripheral portion defining an edge which has at least two pairs of substantially parallel sides, the first pair of sides substantially forming right angles with the second pair of sides, from each of said sides forming part of a polygon and substantially in the same plane, a first flexible supporting plate projects, having a front face which is arranged between the front face and the rear face of said central body, said first plates each having pertinent outer edges and a pair of side edges, said side edges of said first plates being connected to the side edges of second flexible plates which have also each an outer edge, said second plates also having each a front face, said last mentioned front faces corresponding to said second plates being arranged in a different plane than the front faces of said first plates, thus forming between said first and second plates steps and the front face of the central body remaining free, the assembly of said first and second plates defining supporting means for said central body and said first and second plates are linked through their outer edges to a frame, said first and second plates assuring that the front face of said central body is capable of vibrating between parallel planes.

Within the concept of the foregoing definition, it is possible to produce diaphragms both for loudspeakers as well as for microphones. It is also possible to arrange in such diaphragm, within the zones near the perimeter of their central zones, one or several tweeters, when the central zone of the diaphragm is to be connected to a first electro-magnetic driver unit and where such central zones operate as a woofer. In this last embodiment the tweeters, sound emission axes may have pre-determined orientations in order that their respective sound waves are oriented in diverging directions to obtain thus a sound effect which tends to be stereophonic. Each tweeter is mounted in a particular manner in the diaphragm in order to achieve from each tweeter a direct sound emission and another one through the diaphragm.

BRIEF DESCRIPTION OF THE DRAWINGS

To facilitate the comprehension of the invention, reference will now be made to several preferred embodiments by way of example in relationship to the accompanying drawings in which.

DETAILED DESCRIPTION OF PREFERRED EMBODIMENTS OF THE INVENTION

Figure 1:
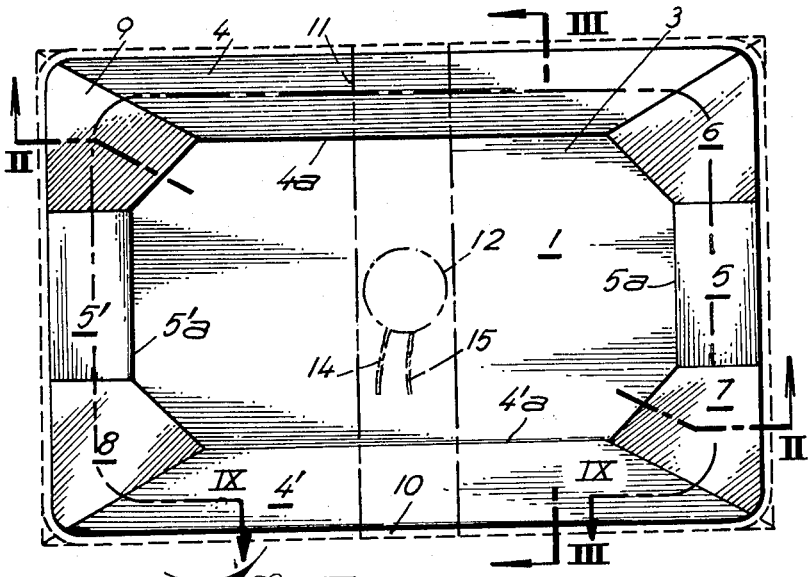
FIG. 1 is a plan view showing the rear face of the diaphragm, including its mounting arrangement.

Referring first to FIGS. 1 to 5, 9, and 10 the mounting of the essentially planar diaphragm defining a sound transducer in accordance with the present invention, comprises a central body 1, having in this embodiment an octogonal shape, to which reference will be made later on, but it will be obvious to those skilled in the art, that any other suitable shape, preferably polygonal shape, may be used.

The central body 1, is preferably made of polystyrene and has a substantially planar front face 2, and a rear face 3, which is preferably arch-shaped, forming the central zone of said central body 1 and having a larger thickness than the zone corresponding to the peripheral portion which defines the polygon. This central body 1 is linked through first resilient or flexible plates 4, 4'; 5, 5' and second flexible or resilient plates 6, 7, 8, and 9 and to which reference will be made later on, to a rectangular frame 10.

On the rectangular frame 10 and facing the rear face, a bridge 11 is mounted which is only shown in phantom lines, since it does not form part of the invention and said bridge 11 supports on its central portion an electro-magnetic assembly 12, likewise shown in phantom lines, inasmuch as it does not form part of the present invention and which includes a coil (not shown) and a driver 13 which is in transmission abutting relationship with the rear face 3 of the diaphragm or central body 1 and more particularly with that portion which has the largest thickness and which is the impact-receiving portion. The electro-magnetic assembly 12 is provided with a pair of cables 14 and 15 to be connected to an amplifier (not shown).

The frame 10 has a T shape cross-section consisting of a web 16 which divides the wing into two half-wings, more particularly the upper half-wing 17 and the lower half-wing 18.

Figure 8:
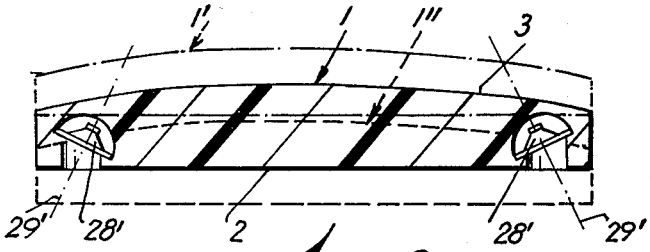
FIG. 8 is an arrangement similar to the one shown in FIG. 7, but showing the position of the tweeters in a different way and which corresponds to a further embodiment.
Figure 9:
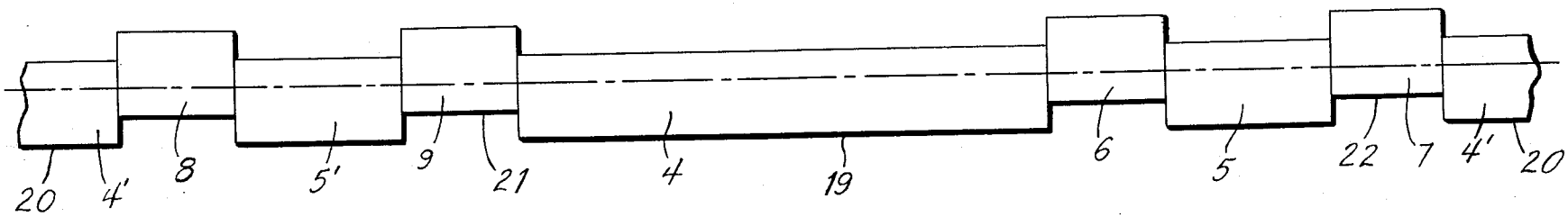
FIG. 9 is a view along IX—IX of FIG. 1.
Figure 10:
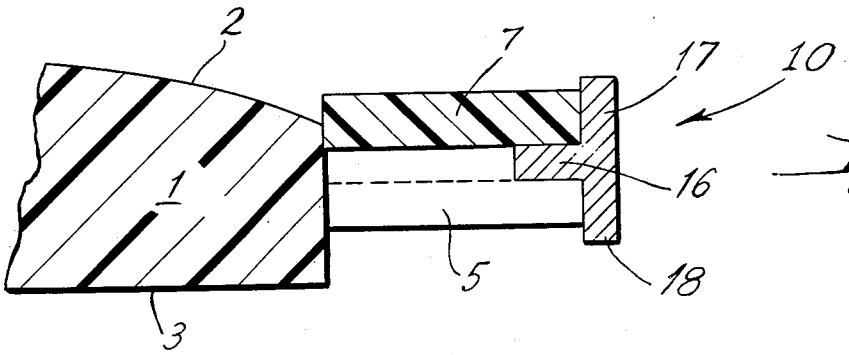
FIG. 10 is a cross-section, at larger scale, similar to FIG. 2.

When the central body 1 vibrates, such as by being driven by the electro-magnetic assembly 12, if the diaphragm operates as a loudspeaker or by a voice, if it operates as a microphone, it is important to achieve that the central body 1 move in a perfectly guided way between its maximum upper position indicated in FIG. 8 by reference numeral 1' and its maximum lower position indicated in FIG. 8, by reference numeral 1'', to assure that the driver 13 linked to the coil of electro-magnetic assembly 12 will not move the coil within the gap in an inadmissible way, to thus avoid that the coil will enter in frictional contact with the magnet (not shown) of the electro-magnetic assembly 12.

To achieve this result, the peripheral portion of the central body 1 defines an edge by means of at least two parallel sides 4*a*, 4'*a* and 5*a*, 5'*a*, where the side 4*a* and 4'*a* on the one hand and 5*a* and 5'*a* on the other hand are substantially opposite. The first pair of sides 4*a* and 4'*a* are located at substantially right angles with regard to the second pair of side 5*a* and 5'*a*. Each of the sides plates 4, 4'; 5, 5' have a respective front face (see for instance FIG. 3: reference numerals 19 and 20) which are arranged between the front face 2 and rear face 3 of the central body. The plates 4, 4' have each the shape of a rectangular trapezoid, whilst the plates 5 and 5' have each the shape of a rectangle.

These first plates 4, 4' and 5, 5' are linked through their outer portions to the lower half-wings 18 and web 16. The material of which these plates 4, 4': 5, 5' are made, is an extremely flexible material, such as foamed neoprene, which in turn is a light material and since they are arranged defining among themselves an octagon, it is assured that the central body will move in the desired way such as explained in relation with FIG. 8, between the positions 1' and 1''.

Figure 2:
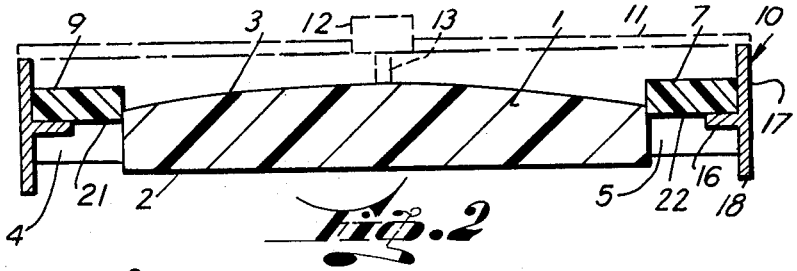
FIG. 2 is a cross-section along line II—II of FIG. 1.
Figure 3:
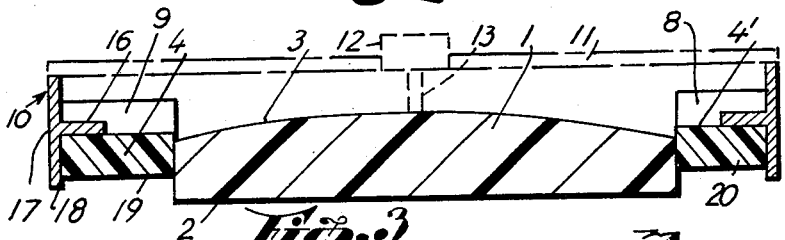
FIG. 3 is a cross-section along line III—III of FIG. 1.
Figure 4:
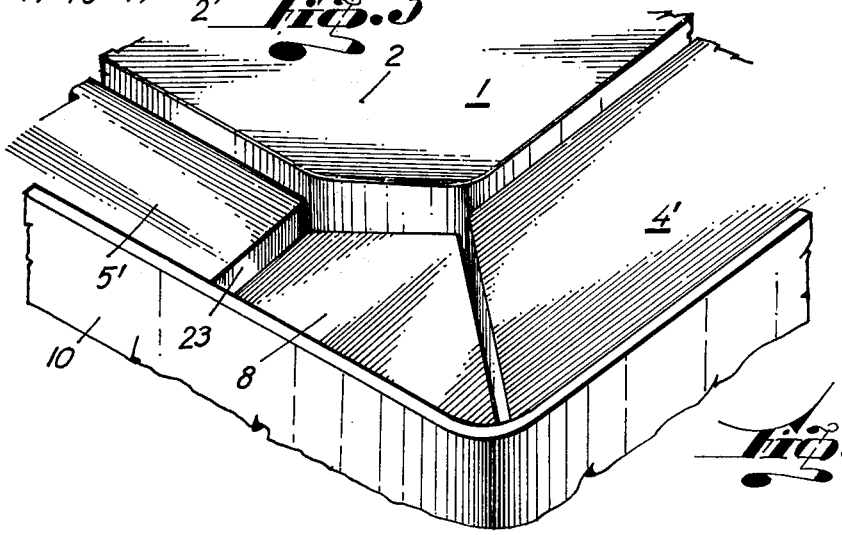
FIG. 4 is a detail in perspective view, at larger scale, of a corner of the mounting means of the diaphragm, showing the front face of the assembly.
Figure 5:
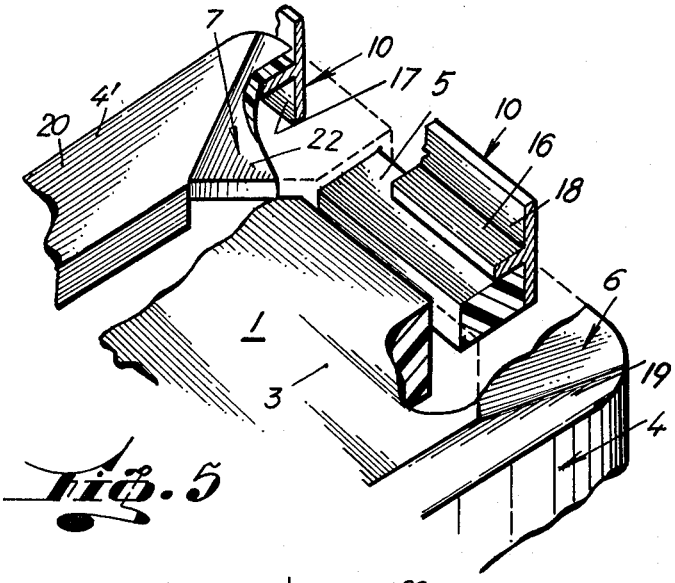
FIG. 5 is a detail in perspective view of a portion of the diaphragm with parts eliminated, but seen from the rear face of the assembly of the present invention.

To avoid the interconnection of air between the front face 2 and the rear face 3, which could otherwise reduce the sound output, it is necessary to link the lateral edges of the second plates 5, 5' with those of the first plates 4, 4', but in such a manner that the supporting features of the plates 4, 4' and 5, 5' are substantially independent. To achieve such a result, the second plates 6, 7, 8 and 9 are used and more particularly the second plate 6 is arranged between the first plates 4 and 5; the second plate 7 is arranged between the first plates 5 and 4'; the second plate 8 is arranged between the first plates 4' and 5' and the second plate 9 is arranged between the first plates 5' and 4. The front faces of said second plates (for instance face 21 of plate 9 and face 22 of plate 7 such as shown in FIG. 2) are arranged in a plane different with regard to front faces 19, 20 of the first plates 4, 4'; 5, 5', thus forming between said first plates 4, 4''; 5, 5' and said second plates 6, 7, 8 and 9, steps (such as step 23, shown in FIG. 4) whereby the front face 2 of the central body 1 remains free, as is clearly shown in FIGS. 2 and 3. Thus, the assembly of the first and second plates defines continuous, uninterrupted supporting means for said central body 1, assuring thus that the supporting means enable that the front face 2 of the central body 1 is capable of moving between parallel planes. (FIG. 8). The first plate 4, 4'; 5, 5', such as explained, are supported by the lower half-wing 18 and the web 16, while the second plates 6, 7, 8 and 9 are supported by the upper half-wing 17 and the web 16.

It is evident that if the central body 1 has a polygonal shape which is different from an octagon, that then the same arrangement may be used and that it is also possible to subdivide in the case of the embodiment of FIG. 1, the plates 4, 4' into several sub-assemblies of first and second plates, if this is desired, for instance in order to achieve special sound effects.

The front faces (for instance 19, 20) of the first plates 4, 4'; 5, 5' are arranged in a plane located between the plane containing the front faces (for instance 21, 22) of the second plates 6, 7, 8, 9 and the plane containing the front face 2 of the central body 1.

Figure 6:
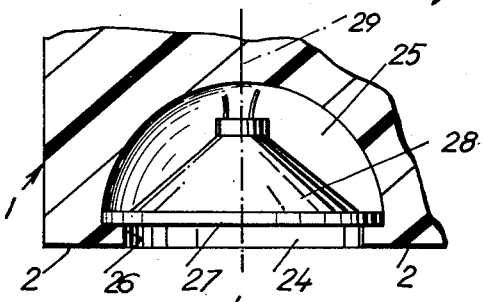
FIG. 6 is a detail in vertical section, showing the mounting of a tweeter within the diaphragm.

When the central body is used to form part of a loudspeaker, for instance for motor-cars, it may be convenient to provide the assembly with at least one tweeter. In accordance with the present invention, the front face 2 (FIG. 6) of the central body 1, has in a zone near one of the plates (4 to 9, not shown in FIG. 6) an opening 24 of a recess 25, which may have the shape of a partial spherical cap and which does not penetrate more than approximately half of the thickness of the central body 1 into the latter, considered in the pertinent portion (see FIGS. 7 and 8). This opening 24 defines an edge 26 on which the peripheral edge of a tweeter 28 is mounted. This peripheral edge defines the opening of the cone of the tweeter. Thus the tweeter produces a direct sound emission at the same time as it transfers its vibrations through the peripheral edge 27 to the central body 1. The sound emission axis 29 of the tweeter 28 may be perpendicular to the plane defining the front face 2 of the central body 1.

Figure 7:
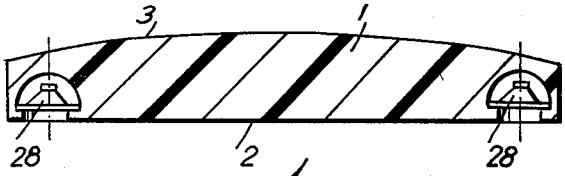
FIG. 7 is a schematical view of the diaphragm, shown in section and illustrating the location of a pair of tweeters in a particular position.

It is also possible to provide more than one tweeter 28, such as shown in FIG. 7. If it is desired to achieve a partial stereophonic effect, then the tweeter 28' (FIG. 8) may be arranged in such a way that the sound emission axes 29' define each an obtuse angle with regard to the plane defined by the front face 2 of the central body 1, so that the axes 29' of the tweeters converge amongst themselves toward the rear face of the central body 1.

It will be understood that improvements may be introduced in the embodiments described by way of example and modifications may be made in the construction and materials employed, without departing from the scope of the invention.

I claim:

1. Mounting of a substantially planar diaphragm defining a sound transducer comprising:

a central body having a substantially planar front face and a rear face, a central portion of said rear face defining an impact receiving zone and a peripheral portion of said central body defining an edge which has at least first and second pairs of substantially parallel sides, the planes of the first pair of sides substantially forming right angles with the planes of the second pair of sides, each of said sides forming part of a polygon and being in substantially the same plane;

frame means for supporting said central body, said frame means being spaced from said sides of said central body; and supporting means positioned in the space between said central body and said frame means for supporting said central body in said frame means in such manner that said front face of said central body is vibratable between parallel planes, said supporting means comprising first and second flexible supporting means, said first flexible supporting means comprising a plurality of first elements spaced apart from each other around the periphery of said central body; each of said first elements having a front face arranged between the front face and rear face of said central body, an outer edge contacting said frame means, an inner edge contacting one of said sides of said central body, and a pair of side edges; and said second flexible supporting means comprising a plurality of second elements located between said first elements of said first flexible supporting means, each of said second elements having an outer edge contacting said frame means, an inner edge contacting one of said sides of said central body, a pair of side edges adjacent respective side edges of said first elements, and a front face arranged between the front face and rear face of said central body in a different plane than the front faces of said first elements so that steps are defined between the front faces of said first and said second elements.

2. The mounting of claim 1, wherein said supporting means defines a continuous, uninterrupted support for said central body.

3. The mounting of claim 1, wherein said first and second elements comprise first and second plates, adjacent side edges of the first and second plates being connected to each other.

4. The mounting of claim 1, wherein said rear face of said central body is arch-shaped, forming a central zone of said central body having a larger thickness than the zone corresponding to the peripheral portion.

5. The mounting of claim 1, wherein the front faces of said first plates are arranged in a plane located between the elements containing the front faces of the second elements and the plane which contains the front face of the central body.

6. The mounting of claim 1, wherein said frame means has a T-shape cross section, forming a web and two half-wings, said outer edges of said first elements being in contact with one of said half-wings of said T and said outer edges of said second elements being in contact with the other half-wing of said T, so that the pertinent portions of said first elements are in contact with one of the faces of the web, while the pertinent portions of the second elements are in contact with the opposite face of the web with regard to the first face of said web.

7. The mounting of claim 1, wherein the front face of the central body has, at a zone near one of said first and second elements, an opening forming part of a recess in which a tweeter is housed.

8. The mounting of claim 7, wherein said opening is defined by an edge on which the peripheral edge of the cone of the tweeter is mounted.

9. The mounting of claim 7 or 8 wherein the tweeter has a frusto-conical diaphragm a sound emission axis which is perpendicular to the plane defined by the front face of the central body.

10. The mounting of claim 1, wherein the front face of said central body, at least in two zones adjacent to said elements, and spaced apart from each other, has an opening forming part of a pertinent recess with an edge, a tweeter being housed in each of said recesses, each tweeter having a peripheral edge which defines the opening of a frusto-conical diaphragm of said tweeter and which rests on said edge and each one of said frusto-conical diaphragms of the pertinent tweeter defining a sound emission axis, the axes of these tweeters each defining an obtuse angle with the plane which is defined by the front face of said central body, so that these emission axes of the tweeters converge one towards the other and towards the rear face of the central body.

* * * * *